US011024213B2

(12) United States Patent
Shen

(10) Patent No.: US 11,024,213 B2
(45) Date of Patent: Jun. 1, 2021

(54) DRIVING DEVICE, DRIVING METHOD AND DISPLAY SYSTEM

(71) Applicant: Wuhan China Star Optoelectronics Semiconductor Display Technology Co., Ltd., Hubei (CN)

(72) Inventor: Lijun Shen, Hubei (CN)

(73) Assignee: WUHAN CHINA STAR OPTOELECTRONICS SEMICONDUCTOR DISPLAY TECHNOLOGY CO., LTD., Hubei (CN)

( * ) Notice: Subject to any disclaimer, the term of this patent is extended or adjusted under 35 U.S.C. 154(b) by 463 days.

(21) Appl. No.: 16/080,548

(22) PCT Filed: Jun. 8, 2018

(86) PCT No.: PCT/CN2018/090428
§ 371 (c)(1),
(2) Date: Aug. 28, 2018

(87) PCT Pub. No.: WO2019/205236
PCT Pub. Date: Oct. 31, 2019

(65) Prior Publication Data

US 2021/0118351 A1 Apr. 22, 2021

(30) Foreign Application Priority Data

Apr. 24, 2018 (CN) ..... 201810375329.4

(51) Int. Cl.
*G09G 3/20* (2006.01)

(52) U.S. Cl.
CPC ..... *G09G 3/2003* (2013.01); *G09G 2310/08* (2013.01); *G09G 2370/04* (2013.01)

(58) Field of Classification Search
CPC ..... G09G 3/2003; G09G 2310/08; G09G 2370/04
See application file for complete search history.

(56) References Cited

U.S. PATENT DOCUMENTS

| | | | | |
|---|---|---|---|---|
| 7,477,172 | B1 | 1/2009 | Lo et al. | |
| 2007/0263713 | A1* | 11/2007 | Aronson | H04N 7/108 375/229 |
| 2015/0370305 | A1* | 12/2015 | Wietfeldt | H04L 25/026 713/320 |
| 2016/0063948 | A1* | 3/2016 | Han | G09G 5/003 345/213 |
| 2017/0032757 | A1* | 2/2017 | Itoigawa | G09G 5/008 |

FOREIGN PATENT DOCUMENTS

| | | | |
|---|---|---|---|
| CN | 106023950 | A | 10/2016 |
| CN | 106409202 | A | 2/2017 |
| CN | 106464267 | A | 2/2017 |
| CN | 107039003 | A | 8/2017 |
| WO | 2017070595 | A1 | 4/2017 |

* cited by examiner

*Primary Examiner* — Brent D Castiaux
(74) *Attorney, Agent, or Firm* — Leong C. Lei

(57) ABSTRACT

A driving device, driving method and display system are disclosed. The driving device includes: a RGB module, a first protocol processing module and a second protocol processing module, a selector, a first deserializer and a second deserializer, and multiple transmitters and multiple connection terminals. The present invention can use two communication methods to achieve the driving, reduce the communication interface and circuit scale, and reduce the cost.

13 Claims, 4 Drawing Sheets

DRIVING DEVICE, DRIVING METHOD AND DISPLAY SYSTEM

RELATED APPLICATIONS

The present application is a National Phase of International Application Number PCT/CN2018/090428, filed Jun. 8, 2018, and claims the priority of China Application No. 201810375329.4, filed Apr. 24, 2018.

FIELD OF THE INVENTION

The present invention relates to the field of driving display technologies, and in particular, to a driving device, a driving method, and a display system.

BACKGROUND OF THE INVENTION

The MIPI Alliance, the Mobile Industry Processor Interface (MIPI) Alliance, defines the communication interface standard for a communication between the host and peripheral devices.

Currently, the communication of a portable terminal device and a display module is most typically MIPI D-PHY (Mobile Industry Processor Interface D-PHY), which includes a pair of differential clock signals and one pair or more and four pairs or less differential data signals for communication. Calculated as 1.5 Gpbs/Lane, a MIPI D-PHY 1 Port supports up to a display module having 1080*3*1920 resolution.

MIPI C-PHY (Mobile Industry Processor Interface C-PHY) is a newly specified high-speed communication interface that meets the requirements of high-resolution display modules in recent years. It uses three signal lines for communication, and three signal lines transmit a high, a medium and a low value signal, respectively, and the clock signal is buried in the three-value signals. The MIPI C-PHY's data rate per lane can reach 2.85 Gbps. The rate per lane is about twice that of the MIPI D-PHY, which can support a display module having a higher resolution.

For a high-resolution display module driver, IC suppliers are also actively developing MIPI C-PHY and MIDI D-PHY 1 port or higher driver ICs to handle high-definition display modules. Therefore, there is a need for a flexible response for driving devices communicated with MIPI D-PHY and MIPI C-PHY. The simplest method is to independently drive the display module using a driving device communicated with the MIPI D-PHY and the MIPI C-PHY, or to integrate the two communication modules independently into the driving device. However, in the above method, the circuit scale is large and the cost is high.

Therefore, in view of the above technical problems, it is necessary to provide a driving device, a driving method, and a display system.

SUMMARY OF THE INVENTION

To overcome the deficiencies of the prior art, the present invention aims to provide a driving device, a driving method, and a display system.

To achieve the foregoing objective, the technical solution provided by an embodiment of the present invention is as follows:

a driving device, comprising: a RGB module for receiving an image data and converting the image data into a RGB signal; a first protocol processing module and a second protocol processing module respectively connected with the RGB module, wherein after the first protocol processing module receives the RGB signal, the first protocol processing module outputs a first signal after processing the RGB signal according to a first protocol standard, and after the second protocol processing module receives the RGB signal, the second protocol processing module outputs a second signal after processing the RGB signal according to a second protocol standard; a selector connected to the first protocol processing module and the second protocol processing module to selectively receive the first signal and the second signal and outputting; a first deserializer and a second deserializer connected to the selector, wherein the first deserializer is configured to decode the first signal and outputs a binary signal data sequence, and the second deserializer is configured to decode the second signal, and outputs a binary signal data sequence; and multiple transmitters and multiple connection terminals, the transmitters are connected with the first deserializer and the second deserializer, and the connection terminals are connected with the transmitters to receive the binary signal data sequences and output a driving signal.

As a further improvement of the present invention, the driving device comprises: a RGB module for receiving an image data and converting the image data into a RGB signal; a C-PHY protocol processing module and a D-PHY protocol processing module respectively connected to the RGB module, wherein after the C-PHY protocol processing module receives the RGB signal, the C-PHY protocol processing module output a MIPI C-PHY signal after processing the RGB signal according to a MIPI C-PHY protocol standard, and after the D-PHY protocol processing module receives the RGB signal, the C-PHY protocol processing module outputs a MIPI D-PHY signal after processing the RGB signal according to a MIPI D-PHY protocol standard; a C-PHY/D-PHY selector connected to the C-PHY protocol processing module and the D-PHY protocol processing module to selectively receive the MIPI C-PHY signal and the MIPI D-PHY signal, and outputting; a C-PHY deserializer and a D-PHY deserializer connected to the C-PHY/D-PHY selector, wherein the C-PHY deserializer is used to decode the MIPI C-PHY signal and outputs a binary signal data sequence, and the D-PHY deserializer is used to decode the MIPI D-PHY signal and outputs a binary signal data sequence; and multiple transmitters and multiple connection terminals connected to the C-PHY deserializer and the D-PHY deserializer, and the connection terminals are connected to the transmitters for receiving the binary signal data sequences and outputting a driving signal.

As a further improvement of the present invention, the driving device further comprises: a clock module connected to the C-PHY deserializer and the D-PHY deserializer for generating a clock signal.

As a further improvement of the present invention, the driving device further comprises: multiple triggers connected to the clock module, the C-PHY deserializer and the D-PHY deserializer, and the triggers combines with the clock signal to synchronously latch the binary signal data output sequences outputted by the C-PHY deserializer and the D-PHY deserializer, and the multiple triggers includes: a first trigger, a second trigger, and a third trigger respectively connected to the C-PHY deserializer and the clock module for generating a trigger clock signal in order to synchronously latch the binary signal data sequence outputted by the C-PHY deserializer; and a fourth trigger and a fifth trigger respectively connected to the D-PHY deserializer and the clock module, for generating a trigger clock signal in order to synchronously latch the binary signal data sequence outputted by the D-PHY deserializer.

As a further improvement of the present invention, the multiple transmitters includes: a first transmitter connected to the first trigger and the fourth trigger; a second transmitter connected to the second trigger and the fifth trigger; a third transmitter connected to the third trigger and the clock signal; wherein the first transmitter, the second transmitter, and the third transmitter are configured to transmit the binary signal data sequence output by the C-PHY deserializer and converting the binary signal data sequence output by the D-PHY deserializer into a differential signal and transmitting.

As a further improvement of the present invention, the connection terminals include: a first connection terminal and the second connection terminal disposed on the first transmitter; a third connection terminal and a fourth connection terminal disposed on the second transmitter; a fifth connection terminal and a sixth connection terminal disposed on the third transmitter; wherein the MIPI C-PHY signal is transmitted through the first connection terminal, the third connection terminal, and the fifth connection terminal; the MIPI D-PHY signal is transmitted through the first connection terminal, the second connection terminal, the third connection terminal, the fourth connection terminal, the fifth connection terminal, and the sixth connection terminal.

As a further improvement of the present invention, the transmitter is provided with an amplifier.

A technology solution provided by another embodiment of the present invention is as followings:

a driving method, comprising steps of: Step S1: receiving an image data by a RGB module and converting the image data into a RGB signal; Step S2: after a first protocol processing module receives the RGB signal, the first protocol processing module outputs a first signal after processing the RGB signal according to a first protocol standard, or after a second protocol processing module receives the RGB signal, the second protocol processing module outputs a second signal after processing the RGB signal according to a second protocol standard; Step S3: selectively receiving the first signal and the second signal by a selector, and outputting; Step S4: decoding the first signal by a first deserializer and outputting a binary signal data sequence, or decoding the second signal by a second deserializer, and outputting a binary signal data sequence; Step S5: receiving the binary signal data sequence outputted by the first deserializer by a transmitter and outputting a binary signal through a connection terminal, or receiving the binary signal data sequence outputted by the second deserializer by the transmitter, and converting the binary signal data sequence into a differential signal and outputting the differential signal.

As a further improvement of the present invention, the driving method specifically comprises steps of: Step S1: receiving an image data by a RGB module and converting the image data into a RGB signal; Step S2: after a C-PHY protocol processing module receives the RGB signal, the C-PHY protocol processing module outputs a MIPI C-PHY signal after processing the RGB signal according to a MIPI C-PHY protocol standard, or after a D-PHY protocol processing module receives the RGB signal, the D-PHY protocol processing module outputs a MIPI D-PHY signal after processing the RGB signal according to a MIPI D-PHY protocol standard; Step S3: selectively receiving the MIPI C-PHY signal and the MIPI D-PHY signal by a C-PHY/D-PHY sector, and outputting; Step S4: decoding the MIPI C-PHY signal by a C-PHY deserializer and outputting a binary signal data sequence, or decoding the MIPI D-PHY signal by a D-PHY deserializer, and outputting a binary signal data sequence; and Step S5: receiving the binary signal data sequence outputted by the C-PHY deserializer by a transmitter and outputting a binary signal through a connection terminal, or receiving the binary signal data sequence outputted by the D-PHY deserializer, converting the binary signal data sequence into a differential signal and outputting the differential signal.

A technology solution provided by another embodiment of the present invention is as followings:

a display system, comprising: a driving device as described above; a connection module electrically connected to a connection terminal in the driving device; a display module connected to the connection module for displaying a data provided by the driving device.

The present invention can use MIPI D-PHY communication and MIPI C-PHY communication to realize a driving, reduce the communication interface and circuit scale, and reduce costs.

BRIEF DESCRIPTION OF THE DRAWINGS

In order to more clearly illustrate the technical solution in the present invention or in the prior art, the following will illustrate the figures used for describing the embodiments or the prior art. It is obvious that the following figures are only some embodiments of the present invention. For the person of ordinary skill in the art without creative effort, it can also obtain other figures according to these figures.

DETAILED DESCRIPTION OF PREFERRED EMBODIMENTS

Figure 1:
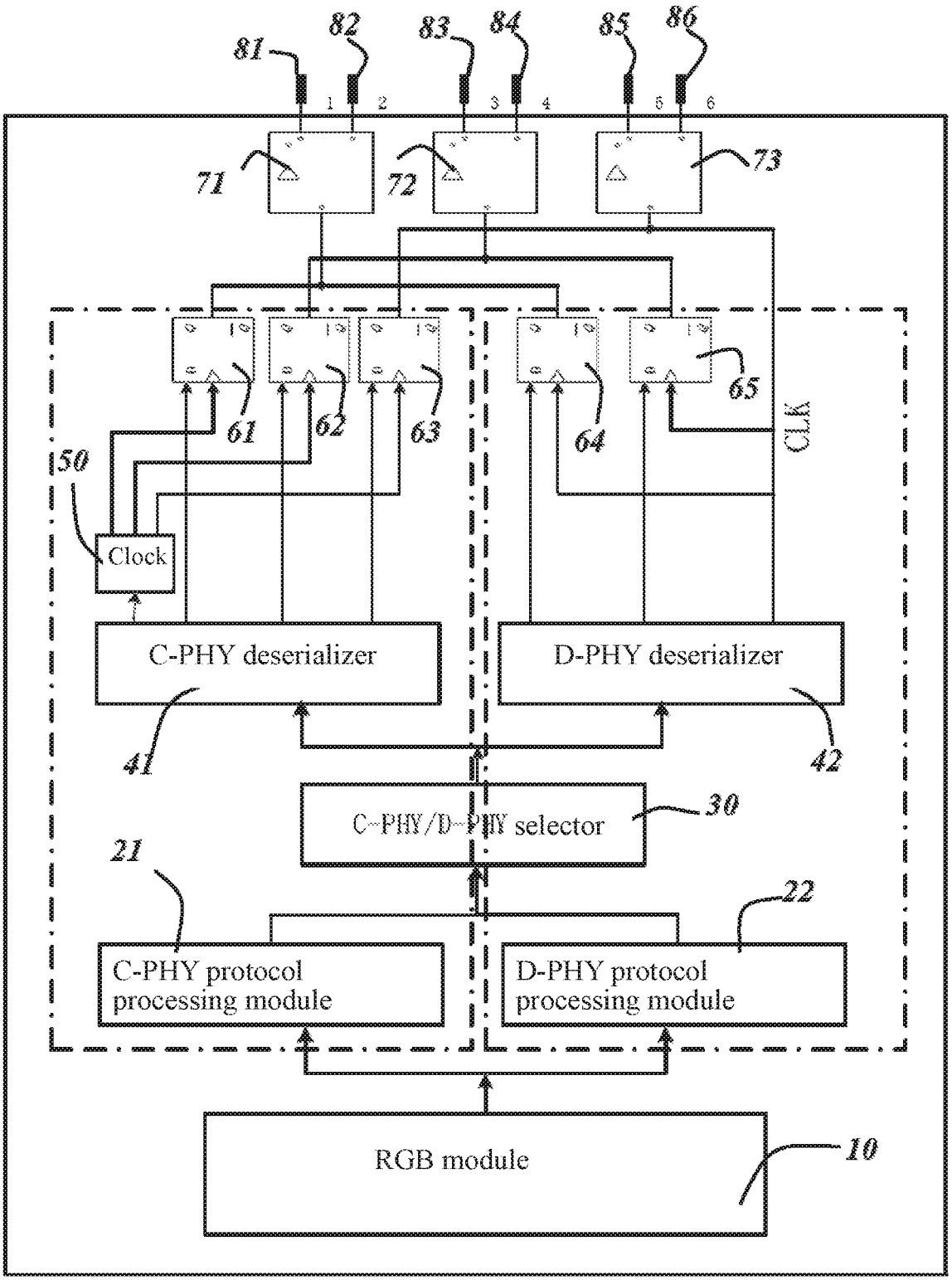
FIG. 1 is a block diagram of a driving device according to a first embodiment of the present invention.

In order to enable those skilled in the art to better understand the technical solution in the present invention, the following content combines with the drawings and the embodiment for describing the present invention in detail. It is obvious that the following embodiments are only some embodiments of the present invention. For the person of ordinary skill in the art without creative effort, the other embodiments obtained thereby are still covered by the present invention.

The invention discloses a driving device comprising:

a RGB module for receiving an image data and converting the image data into a RGB signal;

a first protocol processing module and a second protocol processing module respectively connected with the RGB module, wherein after the first protocol processing module receives the RGB signal, the first protocol processing module outputs a first signal after processing the RGB signal according to a first protocol standard, and after the second protocol processing module receives the RGB signal, the second protocol processing module outputs a second signal after processing the RGB signal according to a second protocol standard;

a selector connected to the first protocol processing module and the second protocol processing module to selectively receive the first signal and the second signal and outputting;

a first deserializer and a second deserializer connected to the selector, wherein the first deserializer is configured to decode the first signal and outputs a binary signal data sequence, and the second deserializer is configured to decode the second signal, and outputs a binary signal data sequence; and multiple transmitters and multiple connection terminals, the transmitters are connected with the first deserializer and the second deserializer, and the connection terminals are connected with the transmitters to receive the binary signal data sequences and output a driving signal.

Preferably, the driving device in the present invention includes:

a RGB module for receiving an image data and converting the image data into a RGB signal;

a C-PHY protocol processing module and a D-PHY protocol processing module respectively connected to the RGB module, wherein after the C-PHY protocol processing module receives the RGB signal, the C-PHY protocol processing module output a MIPI C-PHY signal after processing the RGB signal according to a MIPI C-PHY protocol standard, and after the D-PHY protocol processing module receives the RGB signal, the C-PHY protocol processing module outputs a MIPI D-PHY signal after processing the RGB signal according to a MIPI D-PHY protocol standard;

a C-PHY/D-PHY selector connected to the C-PHY protocol processing module and the D-PHY protocol processing module to selectively receive the MIPI C-PHY signal and the MIPI D-PHY signal, and outputting;

a C-PHY deserializer and a D-PHY deserializer connected to the C-PHY/D-PHY selector, wherein the C-PHY deserializer is used to decode the MIPI C-PHY signal and outputs a binary signal data sequence, and the D-PHY deserializer is used to decode the MIPI D-PHY signal and outputs a binary signal data sequence;

multiple transmitters and multiple connection terminals connected to the C-PHY deserializer and the D-PHY deserializer, and the connection terminals are connected to the transmitters for receiving the binary signal data sequences and outputting a driving signal.

Preferably, the driving device in the present invention further includes:

a clock module connected to the C-PHY deserializer and the D-PHY deserializer for generating a clock signal;

multiple triggers connected to the clock module, the C-PHY deserializer and the D-PHY deserializer, and the triggers combines with the clock signal to synchronously latch the binary signal data output sequences outputted by the C-PHY deserializer and the D-PHY deserializer.

The present invention also discloses a driving method, comprising:

Step S1: receiving an image data by a RGB module and converting the image data into a RGB signal;

Step S2: after a first protocol processing module receives the RGB signal, the first protocol processing module outputs a first signal after processing the RGB signal according to a first protocol standard, or after a second protocol processing module receives the RGB signal, the second protocol processing module outputs a second signal after processing the RGB signal according to a second protocol standard;

Step S3: selectively receiving the first signal and the second signal by a selector, and outputting;

Step S4: decoding the first signal by a first deserializer and outputting a binary signal data sequence, or decoding the second signal by a second deserializer, and outputting a binary signal data sequence;

Step S5: receiving the binary signal data sequence outputted by the first deserializer by a transmitter and outputting a binary signal through a connection terminal, or receiving the binary signal data sequence outputted by the second deserializer by the transmitter, and converting the binary signal data sequence into a differential signal and outputting the differential signal.

Preferably, the driving method in the present invention is specifically:

Step S1: receiving an image data by a RGB module and converting the image data into a RGB signal;

Step S2: after a C-PHY protocol processing module receives the RGB signal, the C-PHY protocol processing module outputs a MIPI C-PHY signal after processing the RGB signal according to a MIPI C-PHY protocol standard, or after a D-PHY protocol processing module receives the RGB signal, the D-PHY protocol processing module outputs a MIPI D-PHY signal after processing the RGB signal according to a MIPI D-PHY protocol standard;

Step S3: selectively receiving the MIPI C-PHY signal and the MIPI D-PHY signal by a C-PHY/D-PHY sector, and outputting;

Step S4: decoding the MIPI C-PHY signal by a C-PHY deserializer and outputting a binary signal data sequence, or decoding the MIPI D-PHY signal by a D-PHY deserializer, and outputting a binary signal data sequence;

Step S5: receiving the binary signal data sequence outputted by the C-PHY deserializer by a transmitter and outputting a binary signal through a connection terminal, or receiving the binary signal data sequence outputted by the D-PHY deserializer, converting the binary signal data sequence into a differential signal and outputting the differential signal.

Furthermore, after the step S4, the method further comprises a step of:

combining triggers with clock signal to synchronously latch the binary signal data output sequence by the C-PHY deserializer and the D-PHY deserializer.

In addition, the present invention also discloses a display system comprising:

a driving device, the driving device is the above-mentioned drive device;

a connection module electrically connected to connection terminal in the driving device;

a display module connected to the connection module for displaying data provided by the driving device.

The following further describes the present invention in combination with specific embodiments.

Embodiment 1

As shown in FIG. 1, the driving device in this embodiment includes:

a RGB module 10 for receiving an image data and converting the image data into a RGB signal. A processor can be FPGA/PSOC, etc.

The C-PHY protocol processing module 21 and the D-PHY protocol processing module 22 respectively connected to the RGB module 10, wherein after the C-PHY protocol processing module 21 receives the RGB signal, the C-PHY protocol processing module 21 outputs a MIPI C-PHY signal after processing the RGB signal according to the MIPI C-PHY protocol standard, and after the D-PHY protocol processing module 22 receives the RGB signal, the C-PHY protocol processing module 22 outputs a MIPI D-PHY signal after processing the RGB signal according to the MIPI D-PHY protocol standard;

a C-PHY/D-PHY selector 30 connected to the C-PHY protocol processing module 21 and the D-PHY protocol processing module 22 to selectively receive the MIPI C-PHY signal and the MIPI D-PHY signal, and outputting;

a C-PHY deserializer 41 and a D-PHY deserializer 42 connected to the C-PHY/D-PHY selector 30, wherein the C-PHY deserializer 41 is used to decode the MIPI C-PHY signal and output a binary signal data sequence, and the D-PHY deserializer 42 is used to decode the MIPI D-PHY signal and outputs a binary signal data sequence;

a clock module 50 connected to the C-PHY deserializer and the D-PHY deserializer for generating a clock signal;

multiple triggers connected to the clock module 50, the C-PHY deserializer 41 and the D-PHY deserializer 42, and the triggers combines with the clock signal to synchronously latch the binary signal data output sequence by the C-PHY deserializer and the D-PHY deserializer.

multiple transmitters and multiple connection terminals connected to the C-PHY deserializer 41 and the D-PHY deserializer 42, and the connection terminal is connected to the transmitter for receiving the binary signal data sequence and outputting a driving signal.

Wherein, the triggers in this embodiment include;

a first trigger 61, a second trigger 62, and a third trigger 63 respectively connected to the C-PHY deserializer 41 and the clock module 50 for generating a trigger clock signal in order to synchronously latch the binary signal data sequence outputted by the C-PHY deserializer 41;

a fourth trigger 64 and a fifth trigger 65 respectively connected to the D-PHY deserializer 42 and the clock module 50, for generating a trigger clock signal in order to synchronously latch the binary signal data sequence outputted by the D-PHY deserializer 42.

The transmitter in this embodiment is provided with an amplifier, wherein the transmitters includes:

a first transmitter 71 connected to the first trigger 61 and the fourth trigger 64;

a second transmitter 72 connected to the second trigger 62 and the fifth trigger 65;

a third transmitter 73 connected to the third trigger 63 and the clock signal 50;

wherein the first transmitter 71, the second transmitter 72, and the third transmitter 73 are configured to transmit the binary signal data sequence outputted by the C-PHY deserializer and converting the binary signal data sequence outputted by the D-PHY deserializer into a differential signal and transmitting the differential signal.

The signal in the driving device is transmitted to the external display module through a connecting terminal. The connection terminal includes:

a first connection terminal 81 and a second connection terminal 82 disposed on the first transmitter 71;

a third connection terminal 83 and a fourth connection terminal 84 disposed on the second transmitter 72;

a fifth connection terminal 85 and a sixth connection terminal 86 disposed on the third transmitter 73;

Wherein the MIPI C-PHY signal is transmitted through the first connection terminal 81, the third connection terminal 83, and the fifth connection terminal 85. The MIPI D-PHY signal is transmitted through the first connection terminal 81, the second connection terminal 82, the third connection terminal 83, the fourth connection terminal 84, the fifth connection terminal 85, and the sixth connection terminal 86.

In this embodiment, five triggers, three transmitters, and six connection terminals are used as examples for description. In other embodiments, according to different data channels of the MIPI D-PHY, the number of the triggers and connection terminals may be increased accordingly. The quantity is not described in detail here.

Embodiment 2

The driving method in this embodiment uses the driving device in Embodiment 1 as an example. The driving method includes:

Step 1: receiving an image data by a RGB module and converting the image data into a RGB signal;

Step 2: after a C-PHY protocol processing module receives the RGB signal, the C-PHY protocol processing module outputs a MIPI C-PHY signal after processing the RGB signal according to a MIPI C-PHY protocol standard, or after a D-PHY protocol processing module receives the RGB signal, the D-PHY protocol processing module outputs a MIPI D-PHY signal after processing the RGB signal according to a MIPI D-PHY protocol standard;

Step 3: selectively receiving the MIPI C-PHY signal and the MIPI D-PHY signal by a C-PHY/D-PHY, and outputting;

Step 4: decoding the MIPI C-PHY signal by a C-PHY deserializer and outputting a binary signal data sequence, or decoding the MIPI D-PHY signal by a D-PHY deserializer, and outputting a binary signal data sequence;

Step 5: combining triggers with a clock signal to synchronously latch the binary signal data output sequence by the C-PHY deserializer and the D-PHY deserializer;

Step 6: receiving the binary signal data sequence outputted by the C-PHY deserializer by a transmitter and outputting a binary signal through a connection terminal, or receiving the binary signal data sequence outputted by the second deserializer by the D-PHY, converting the binary signal data sequence into a differential signal and outputting the differential signal.

The driving method in this embodiment includes MIPI C-PHY communication and MIPI D-PHY communication.

Figure 2:
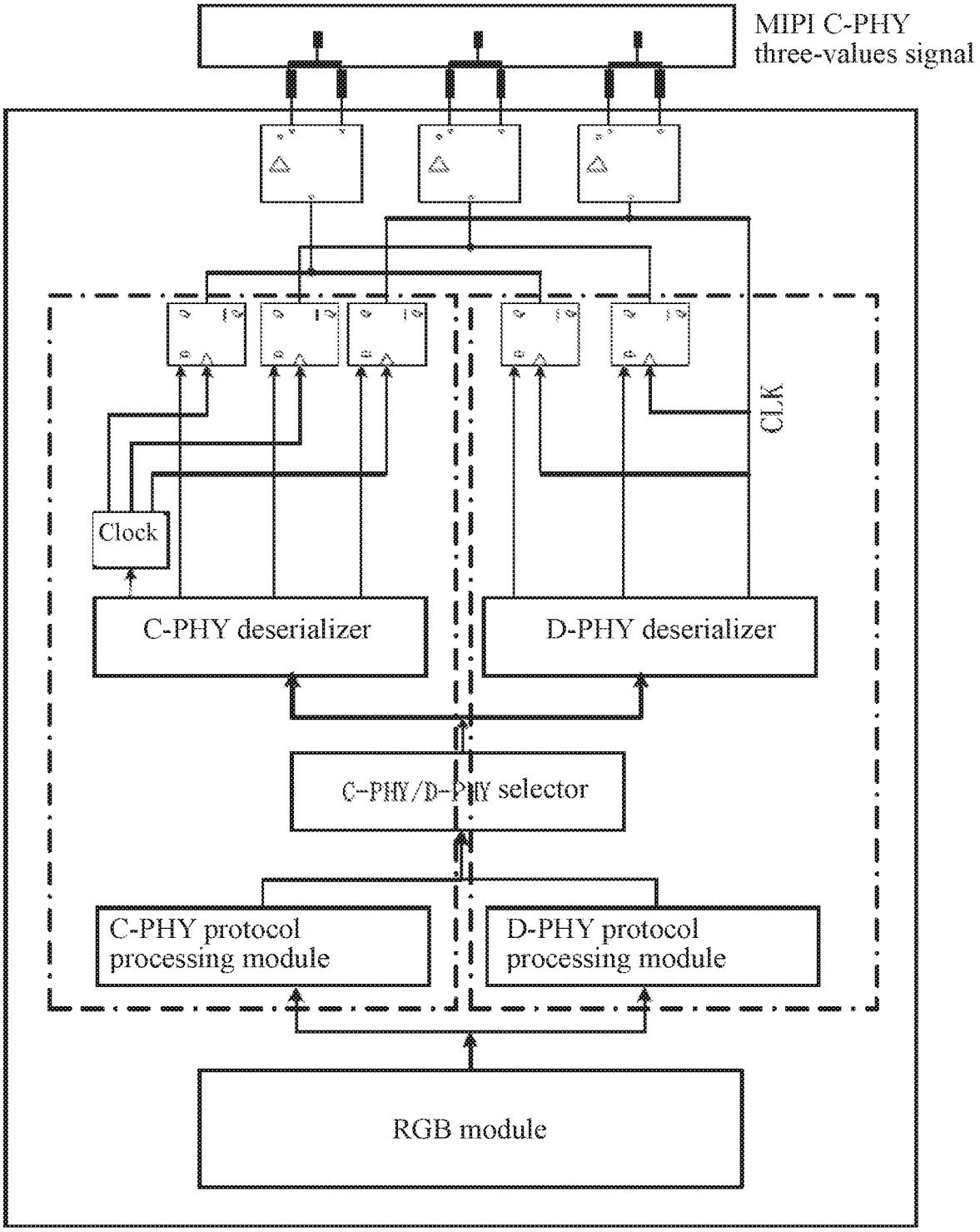
FIG. 2 is a block diagram of MIPI C-PHY communication according to a second embodiment of the present invention.

Referring to FIG. 2, when the MIPI C-PHY communicates, the C-PHY/D-PHY selector selects the MIPI C-PHY signal and transmits the MIPI C-PHY signal to the MIPI C-PHY deserializer. The MIPI C-PHY deserializer decodes the MIPI C-PHY signal, and outputs the binary signal data sequence. At this time, the MIPI D-PHY deserializer has no data sequence output. The binary signal data sequence is received by the first trigger, the second trigger, and the third trigger, and is clock-regenerated with the deserializer clock received by the clock module to generate a trigger clock signal to synchronously latch the data sequence. The binary signal data sequence generated by the trigger is transmitted to the transmitter, and the first to third transmitters transmit the data sequence to the first connection terminal, the third connection terminal, and the fifth connection terminal, and are further transmitted to the display module for driving.

Figure 3:
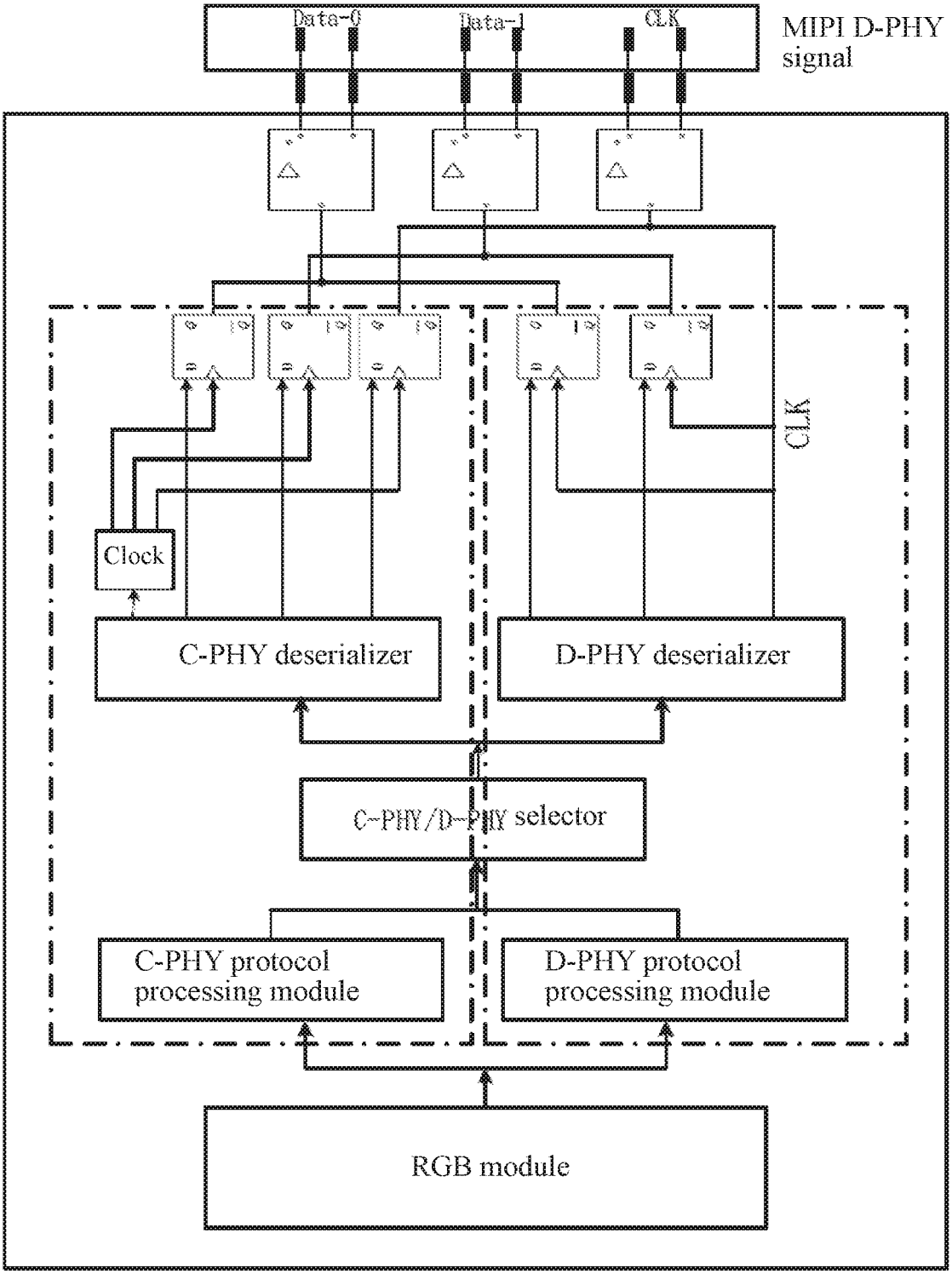
FIG. 3 is a block diagram of MIPI D-PHY communication according to a second embodiment of the present invention.

Referring to FIG. 3, when the MIPI D-PHY is communicated, the C-PHY/D-PHY selector selects the MIPI D-PHY signal and transmits the MIPI D-PHY signal to the MIPI D-PHY deserializer. The MIR D-PHY deserializer decodes the MIPI D-PHY signal, and outputs the binary signal data sequence. At this time, the MIPI C-PHY deserializer has no data sequence output. The data sequence of the binary signal is received by the fourth trigger and the fifth trigger, and with the CLK to synchronously latch the data sequence. The binary signal data sequence generated by the trigger is transmitted to the transmitter, and the first to third transmitters convert the received binary signal into a differential signal, and the connection terminal transmits the signal through the first connection terminal to the sixth connection terminal to the display module.

Embodiment 3

Figure 4:
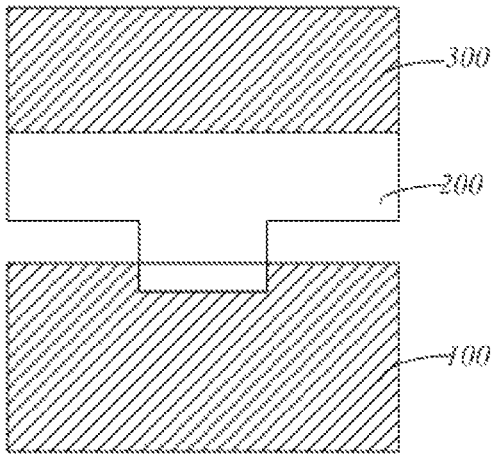
FIG. 4 is a schematic structural diagram of a display system according to a third embodiment of the present invention.

As shown in FIG. 4, the display system in this embodiment includes:

a driving device 100 and the driving device may be the driving device in the embodiment 1, and will not be further described herein. The driving device provides a required image/audio/video data and voltage for display;

a connection module 200 electrically connected to the connection terminal in the driving device 100. The connection module may be an FPCA or a connection cable, and the connection terminal may be an interface mode such as ZIF/BTB/DIP;

a display module 300 connected to the connection module 200 for displaying the data provided by the driving device. The display module may be a liquid crystal display panel or an AMOLED display panel, and displays data such as images/audio/video data provided by the driving device.

It should be understood that in the above embodiments, the protocol processing module uses the C-PHY protocol processing module and the D-PHY protocol processing module as examples, and the C-PHY protocol processing module and the D-PHY protocol processing module follow the MIPI C-PHY protocol standard and MIPI D-PHY protocol standard to process RGB signals to output the MIPI C-PHY signal and the MIPI D-PHY signal; the selector uses C-PHY/D-PHY selector to selectively receive MIPI C-PHY signal and the MIPI D-PHY signal, and outputting; the deserializer includes the C-PHY deserializer and the D-PHY deserializer to decode the MIPI C-PHY signals and the MIPI D-PHY signal, and outputting the binary signal data sequence. In another embodiment, different protocol processing modules, selectors, and deserializers may be selected according to different communication protocols and signals, which will not be described here.

The embodiment of the invention also provides an electronic device. The electronic device includes at least one processor and a memory coupled to the at least one processor, the memory storing instructions executable by the at least one processor, the instructions being executed by the at least one processor. At this time, the at least one processor is caused to perform the driving method in the above embodiment.

An embodiment of the present invention further provides a non-transitory storage medium, storing computer-executable instructions, and the computer-executable instructions are configured to execute the above-mentioned driving method.

An embodiment of the present invention further provides a computer program product, the computer program product comprising a computer program stored on a non-transitory computer-readable storage medium, the computer program comprising program instructions when the program instructions are executed by a computer. At this time, the computer is caused to execute the above driving method.

The driving apparatus provided by the embodiment of the present invention can execute the driving method provided by any embodiment of the present invention, and has the corresponding functional modules and beneficial effects of the execution method. For technical details that are not described in detail in the above embodiments, reference may be made to the driving method provided by any embodiment of the present invention.

Compared with the prior art, the present invention has the following beneficial effects: the present invention can use MIPI D-PHY communication and MIPI C-PHY communication to realize a driving, reduce the communication interface and circuit scale, and reduce costs.

For the person skilled in the art, obviously, the present invention is not limited to the detail of the above exemplary embodiment. Besides, without deviating the spirit and the basic feature of the present invention, other specific forms can also achieve the present invention. Therefore, no matter from what point of view, the embodiments should be deemed to be exemplary, not limited. The range of the present invention is limited by the claims not by the above description. Accordingly, the embodiments are used to include all variation in the range of the claims and the equivalent requirements of the claims. It should not regard any reference signs in the claims as a limitation to the claims.

Besides, it can be understood that, although the present disclosure is describe according to the embodiments, each embodiment does not include only on dependent technology solution. The description of the present disclosure is only for clarity. The person skilled in the art should regard the present disclosure as an entirety. Technology solutions in the embodiments can be adequately combined to form other embodiments that can be understood by the person skilled in the art.

What is claimed is:

1. A driving device, wherein the driving device comprises:

a RGB module, which comprises a processor for receiving an image data and converting the image data into a RGB signal;

a C-PHY protocol processing module and a D-PHY protocol processing module respectively connected to the RGB module, wherein after the C-PHY protocol processing module receives the RGB signal, the C-PHY protocol processing module outputs a MIPI C-PHY signal as a processing result of processing of the RGB signal according to a MIPI C-PHY protocol standard, and after the D-PHY protocol processing module receives the RGB signal, the D-PHY protocol processing module outputs a MIPI D-PHY signal as a processing result of processing of the RGB signal according to a MIPI D-PHY protocol standard;

a C-PHY/D-PHY selector connected to the C-PHY protocol processing module and the D-PHY protocol processing module to selectively receive the MIPI C-PHY signal and the MIPI D-PHY signal, and outputting the MIPI C-PHY signal or the MIPI D-PHY signal so received;

a C-PHY deserializer and a D-PHY deserializer connected to the C-PHY/D-PHY selector, wherein the C-PHY deserializer decodes the MIPI C-PHY signal and outputs a binary signal data sequence of the MIPI C-PHY signal, and the D-PHY deserializer decodes the MIPI D-PHY signal and outputs a binary signal data sequence of the MIPI D-PHY signal; and multiple transmitters and multiple connection terminals connected to the C-PHY deserializer and the D-PHY deserializer, wherein the connection terminals are connected to the transmitters to receive the binary signal data sequences from the multiple transmitters and outputting the binary signal data sequences as a driving signal;

wherein the C-PHY protocol processing module and the D-PHY protocol processing module process the RGB signal of the image data to provide the MIPI C-PHY signal and the MIPI D-PHY signal, which are subsequently subject to deserialization to convert into the binary signal data sequences to be output through the multiple connection terminals, wherein the RGB signal of the image data is first processed by the C-PHY protocol processing module and the D-PHY protocol processing module first to provide a processing result that is subsequently deserialized to form the driving signal.

2. The driving device according to claim 1, wherein the driving device further comprises: a clock module connected to the C-PHY deserializer and the D-PHY deserializer for generating a clock signal.

3. The driving device according to claim 2, wherein the driving device further comprises: multiple triggers connected to the clock module, the C-PHY deserializer and the D-PHY deserializer, and the triggers are operable in combination with the clock signal to synchronously latch the binary signal data sequences outputted by the C-PHY deserializer and the D-PHY deserializer, and the multiple triggers includes:

a first trigger, a second trigger, and a third trigger respectively connected to the C-PHY deserializer and the clock module for generating a trigger clock signal in order to synchronously latch the binary signal data sequence outputted by the C-PHY deserializer; and a fourth trigger and a fifth trigger respectively connected to the D-PHY deserializer and the clock module, for generating a trigger clock signal in order to synchronously latch the binary signal data sequence outputted by the D-PHY deserializer.

4. The driving device according to claim 3, wherein the multiple transmitters include:

a first transmitter connected to the first trigger and the fourth trigger;

a second transmitter connected to the second trigger and the fifth trigger; and a third transmitter connected to the third trigger and the clock signal;

wherein the first transmitter, the second transmitter, and the third transmitter are configured to transmit the binary signal data sequence output by the C-PHY deserializer and converting the binary signal data sequence output by the D-PHY deserializer into a differential signal and transmitting the differential signal.

5. The driving device according to claim 4, wherein the connection terminals include:

a first connection terminal and a second connection terminal disposed on the first transmitter;

a third connection terminal and a fourth connection terminal disposed on the second transmitter; and a fifth connection terminal and a sixth connection terminal disposed on the third transmitter;

wherein the MIPI C-PHY signal is transmitted through the first connection terminal, the third connection terminal, and the fifth connection terminal; the MIPI D-PHY signal is transmitted through the first connection terminal, the second connection terminal, the third connection terminal, the fourth connection terminal, the fifth connection terminal, and the sixth connection terminal.

6. The driving device according to claim 4, wherein the is transmitters are provided with an amplifier.

7. A display system, comprising:

the driving device as claimed in claim 1;

a connection module electrically connected to the multiple connection terminals of the driving device; and a display module connected to the connection module for displaying a data provided by the driving device.

8. The display system according to claim 7, wherein the driving device further comprises: a clock module connected to the C-PHY deserializer and the D-PHY deserializer for generating a clock signal.

9. The display system according to claim 8, wherein the driving device further comprises: multiple triggers connected to the clock module, the C-PHY deserializer and the D-PHY deserializer, and the triggers are operable in combination with the clock signal to synchronously latch the binary signal data output sequences outputted by the C-PHY deserializer and the D-PHY deserializer, and the multiple triggers includes:

a first trigger, a second trigger, and a third trigger respectively connected to the C-PHY deserializer and the clock module for generating a trigger clock signal in order to synchronously latch the binary signal data sequence outputted by the C-PHY deserializer; and a fourth trigger and a fifth trigger respectively connected to the D-PHY deserializer and the clock module, for generating a trigger clock signal in order to synchronously latch the binary signal data sequence outputted by the D-PHY deserializer.

10. The display system according to claim 9, wherein the multiple transmitters include:

a first transmitter connected to the first trigger and the fourth trigger;

a second transmitter connected to the second trigger and the fifth trigger; and a third transmitter connected to the third trigger and the clock signal;

wherein the first transmitter, the second transmitter, and the third transmitter are configured to transmit the binary signal data sequence output by the C-PHY deserializer and converting the binary signal data sequence output by the D-PHY deserializer into a differential signal and transmitting the differential signal.

11. The display system according to claim 10, wherein the connection terminals include:

a first connection terminal and a second connection terminal disposed on the first transmitter;

a third connection terminal and a fourth connection terminal disposed on the second transmitter; and a fifth connection terminal and a sixth connection terminal disposed on the third transmitter;

wherein the MIPI C-PHY signal is transmitted through the first connection terminal, the third connection terminal, and the fifth connection terminal; the MIPI D-PHY signal is transmitted through the first connection terminal, the second connection terminal, the third connection terminal, the fourth connection terminal, the fifth connection terminal, and the sixth connection terminal.

12. The display system according to claim 10, wherein the transmitters are provided with an amplifier.

13. A driving method, wherein the driving method comprises the following steps:

Step S1: receiving an image data and converting the image data into a RGB signal;

Step S2: a C-PHY protocol processing module receiving the RGB signal, and the C-PHY protocol processing module outputting a MIPI C-PHY signal as a processing result of processing of the RGB signal according to a MIPI C-PHY protocol standard, or a D-PHY protocol processing module receiving the RGB signal, and the D-PHY protocol processing module outputting a MIPI D-PHY signal as a processing result of processing of the RGB signal according to a MIPI D-PHY protocol standard;

Step S3: selectively receiving the MIPI C-PHY signal and the MIPI D-PHY signal by a C-PHY/D-PHY selector, and outputting the MIPI C-PHY signal or the MIPI D-PHY signal so received;

Step S4: decoding the MIPI C-PHY signal by a C-PHY deserializer and outputting a binary signal data sequence of the MIPI C-PHY signal, or decoding the MIPI D-PHY signal by a D-PHY deserializer and outputting a binary signal data sequence of the MIPI D-PHY signal; and Step S5: receiving the binary signal data sequence outputted by the C-PHY deserializer by a transmitter and outputting a binary signal through a connection terminal, or receiving the binary signal data sequence outputted by the D-PHY deserializer, converting the binary signal data sequence into a differential signal and outputting the differential signal;

wherein the C-PHY protocol processing module and the D-PHY protocol processing module process the RGB signal of the image data to provide the MIPI C-PHY signal and the MIPI D-PHY signal, which are subsequently subject to deserialization to convert into the binary signal data sequences to be output through the multiple connection terminals, wherein the RGB signal of the image data is first processed by the C-PHY protocol processing module and the D-PHY protocol processing module first to provide a processing result that is subsequently deserialized to form the driving signal.

* * * * *